US005454560A

United States Patent [19]

Pan

[11] Patent Number: 5,454,560

[45] Date of Patent: Oct. 3, 1995

[54] MULTIPURPOSE BASE BAG

[76] Inventor: Shih-Chin Pan, No. 31, Alley 100, Lane 59 Nan-Yang Rd., Fengyuan City, Taiwan

[21] Appl. No.: 231,509

[22] Filed: Apr. 22, 1994

[51] Int. Cl.[6] ..... A63B 71/00

[52] U.S. Cl. ..... 273/25; 229/125.39

[58] Field of Search ..... 273/25; 383/7, 383/8, 26, 27, 31, 35, 200, 210, 53, 58, 61, 66, 78, 84, 89, 98; 229/117.25, 117.26, 121, 122.2, 125.39, 132, 131, 137, 138, 153, 181, 189, 193, 198

[56] References Cited

U.S. PATENT DOCUMENTS

| | | | |
|---|---|---|---|
| 2,118,927 | 4/1938 | Alfred | 229/125.39 |
| 2,937,872 | 5/1960 | Gilman | 273/55 A |
| 3,181,863 | 5/1965 | Nellermoe | 273/25 |
| 3,384,372 | 5/1968 | Dickens | 273/55 A |
| 3,608,707 | 9/1971 | Miller | 229/125.39 |
| 4,556,167 | 12/1985 | Fox | 229/125.39 |
| 5,000,448 | 3/1991 | Anderson | 273/25 |

*Primary Examiner*—Theatrice Brown
*Attorney, Agent, or Firm*—Morton J. Rosenberg; Klein: David I.

[57] ABSTRACT

A multipurpose base bag includes a rectangular bag body having an opening at one side and side flaps around the opening and fastened together by fastening elements thereof to close up the opening, and a sponge received inside the bag body. An air bag may be alternatively used to replace the sponge so that the base bag can be served as a life bag.

5 Claims, 5 Drawing Sheets

MULTIPURPOSE BASE BAG

BACKGROUND OF THE INVENTION

The present invention relates to base bags, and more particularly to a multipurpose base bag which can be so alternatively arranged that it can be used as a base bag for baseball game, a life bag for water sports, or a training bag for boxing game.

A base bag for baseball game is generally comprised of a substantially rectangular bag body stuffed with a high-density sponge and having at least one strap for fastening. Because the bag body must be sealed by stitches after the high-density sponge is filled, the manufacturing speed is slow. When the base bag is made, it occupies much storage space, and therefore its delivery cost is high. Furthermore, this structure of base bag is simply provided for use in base ball game and does not provide any additional functions.

SUMMARY OF THE INVENTION

It is one object of the present invention to provide a base bag which is easy to manufacture. It is another object of the present invention to provide a base bag which is so arranged that the stuff thereof can be replaceable. It is still another object of the present invention to provide a base bag which can be so alternatively arranged that it can be used as a base bag for baseball game, a life bag for water sports, or a training bag for boxing game.

According to one aspect of the present invention, the base bag comprises a rectangular bag body having an opening at one side and side flaps around the opening and fastened together by fastening elements thereof to close up the opening, and a sponge received inside the bag body. According to another aspect of the present invention, an air bag may be alternatively used to replace the sponge so that the base bag can be served as a life bag. According to still another aspect of the present invention, hand holes are made on the bag body at suitable locations so that the base bag can be held with the hands for use in boxing training.

DETAILED DESCRIPTION OF THE PREFERRED EMBODIMENTS

Figure 2:
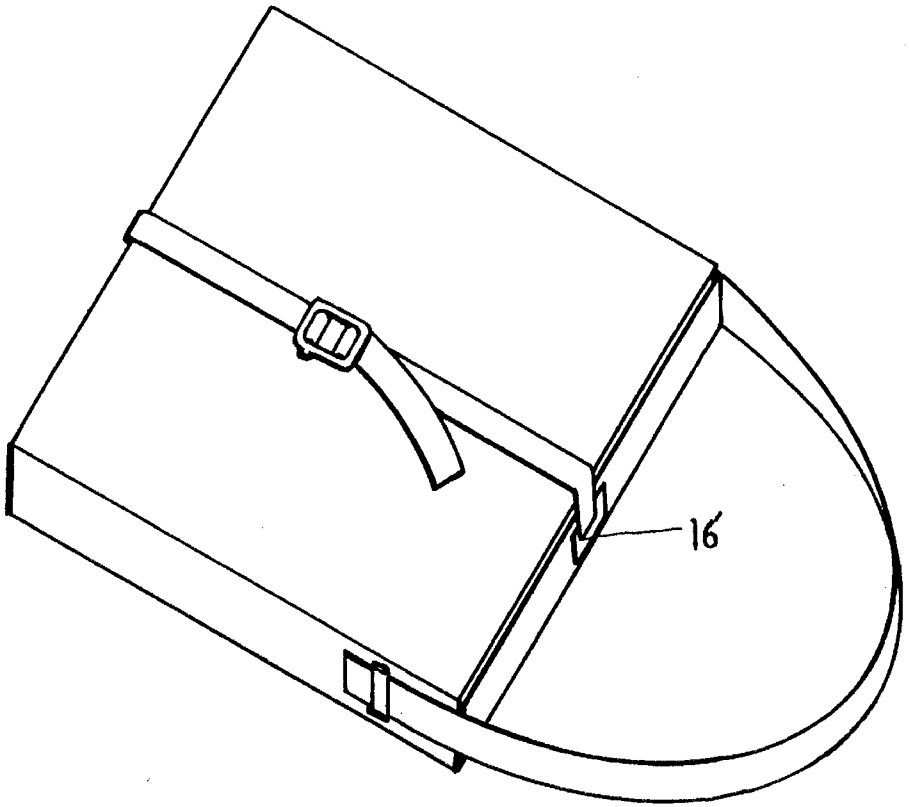
FIG. 2 is an elevational view of a base bag according to another embodiment of the present invention.

Referring to FIGS. 3 through 6, a base is comprised of a rectangular bag body 1 having an opening 11 at one side through which a sponge 4 or air bag 5 is inserted into the bag body 1, and four flaps, namely, the first lateral flap 12, the second lateral flap 13, the front side flap 14 and the back side flap 15 disposed around the opening 11 at four sides, wherein the first lateral flap 12 has a first fastening element 121; the second lateral flap 13 has a second fastening element 131; the front side flap 14 has a third fastening element 141 and a fourth fastening element 142 disposed at two opposite sides and a fifth fastening element 143 in the middle; the back side flap 15 has a six fastening element 151 corresponding to the fifth fastening element 143 on the front side flap 14. When the sponge 4 or air bag 5 is put into the bag body 1, the first and second fastening elements 121;131 are respectively fastened to the third and fourth fastening elements 141;142 and the fifth fastening element 143 is fastened to the six fastening element 151, and therefore the first and second lateral flaps 12;13 and the front and back side flaps 14;15 are fastened together to close the opening 11. The fastening elements 121;131;141;142; 143;151 may be made from velcro tapes or like means.

Figure 1:
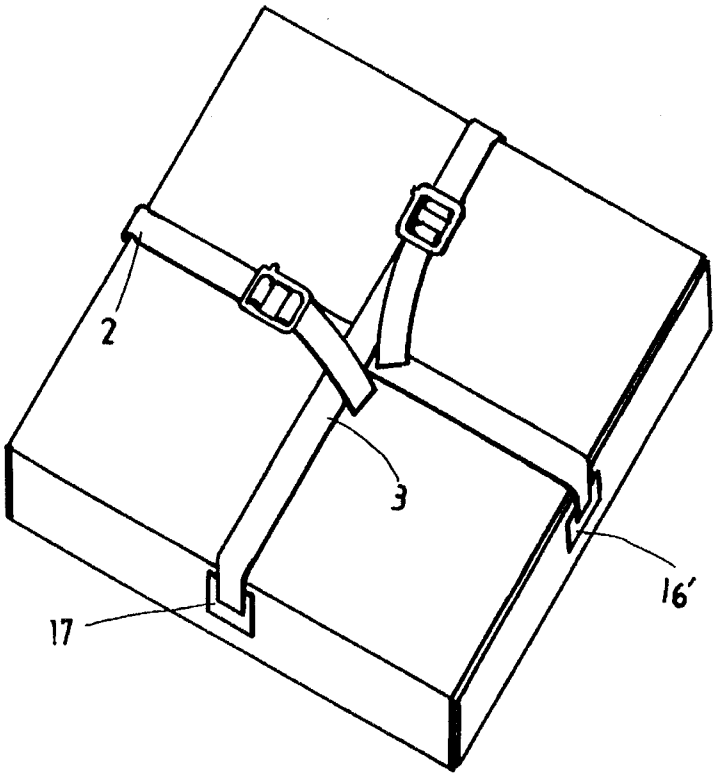
FIG. 1 is an elevational view of a base bag according to one embodiment of the present invention.
Figure 3:
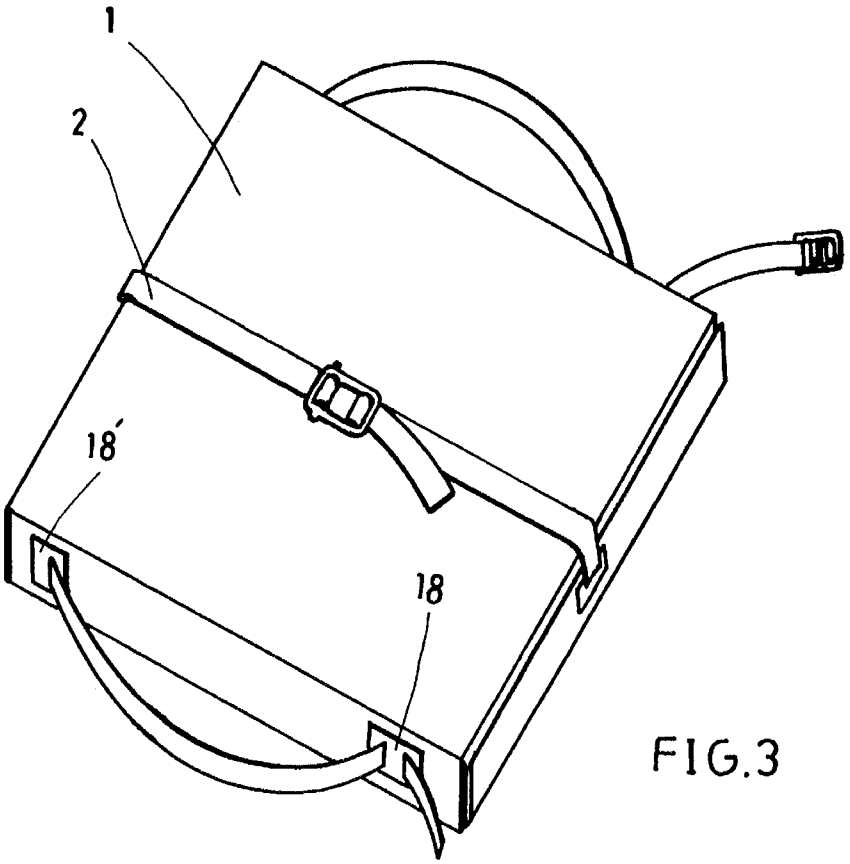
FIG. 3 is an elevational view of a base bag according to still another embodiment of the present invention.
Figure 5:
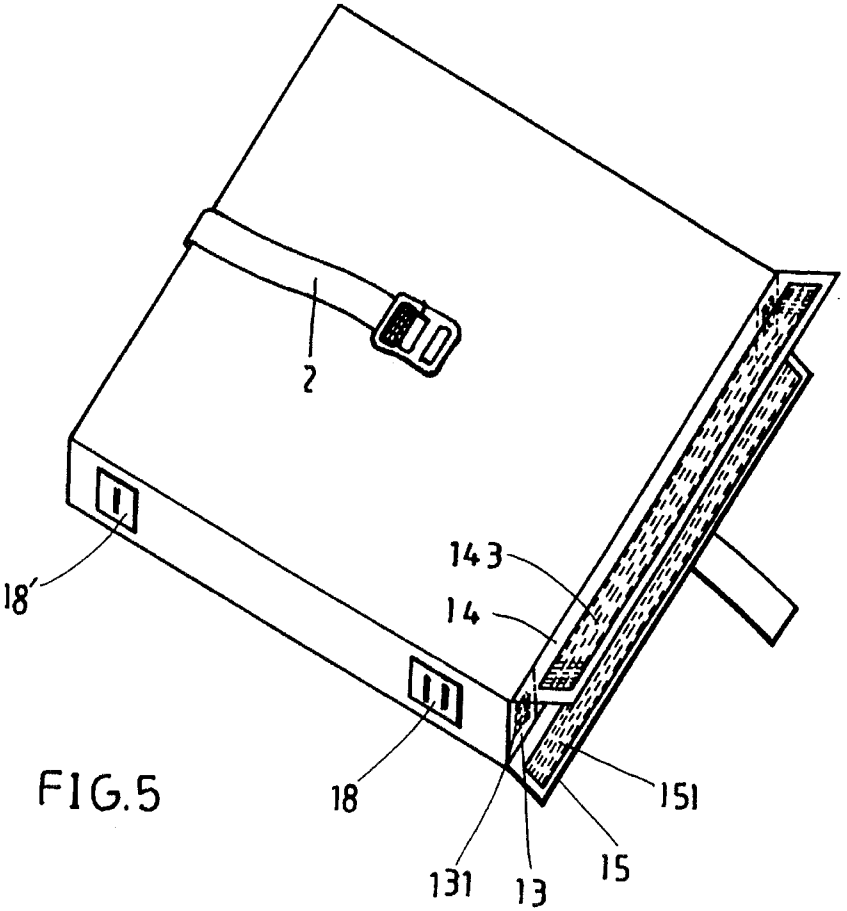
FIG. 5 is similar to FIG. 4 but showing the sponge inserted into the bag body and the first and second lateral flaps folded up.
Figure 4:
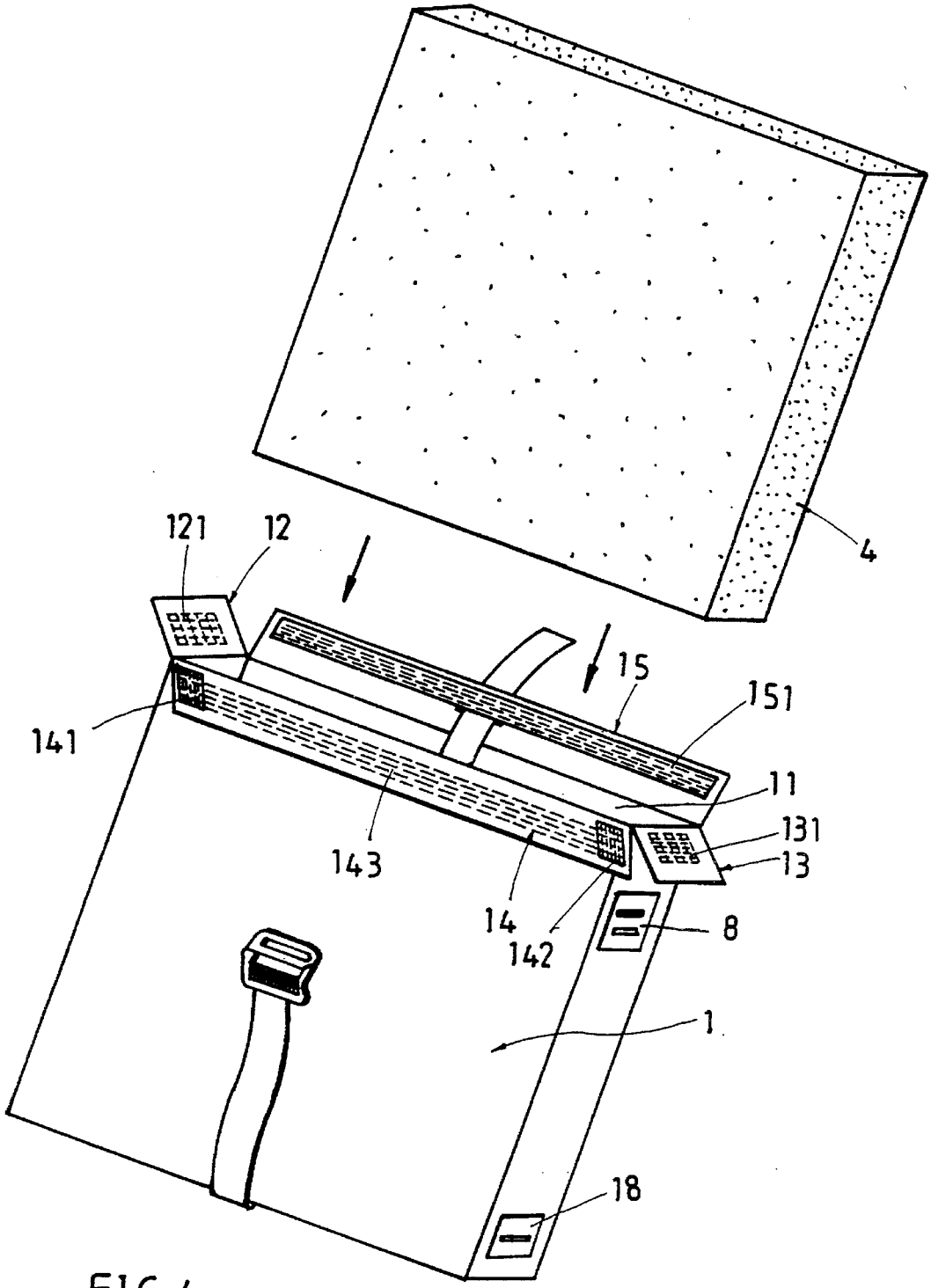
FIG. 4 is an exploded view of the base bag shown in FIG. 3.

Referring to FIGS. 1 and 2, two first strap slots 16;16' are made respectively made on two opposite peripheral sides of the bag body 1 for mounting a first strap 2, and another two strap slots 17;17' are made on another two opposite peripheral sides of the bag body 1 for mounting a second strap 3. The first and second straps are crossed over each other for fastening to the anchor at either base within the baseball field.

Figure 6:
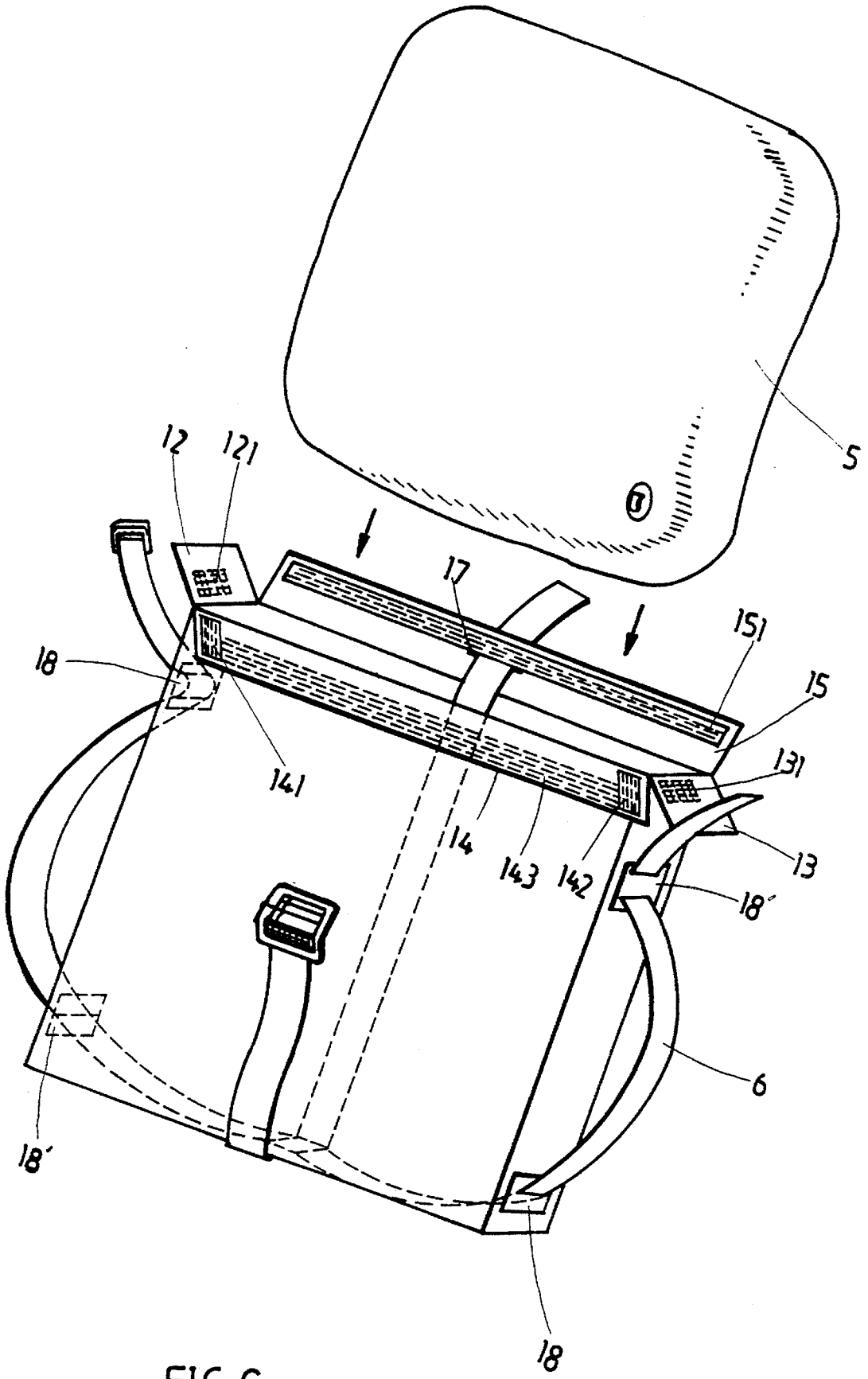
FIG. 6 is similar to FIG. 4 but showing the sponge replaced by an air bag.

Referring to FIG. 6, hand holes 18;18' may be made on the bag body 1 at suitable locations so that the bag body 1 can be held by hand for use in box training.

In this embodiment, second strap member 6 passes through hand holes 18, 18' as shown to allow a user to pass his or her arms through the openings formed.

Figure 7:
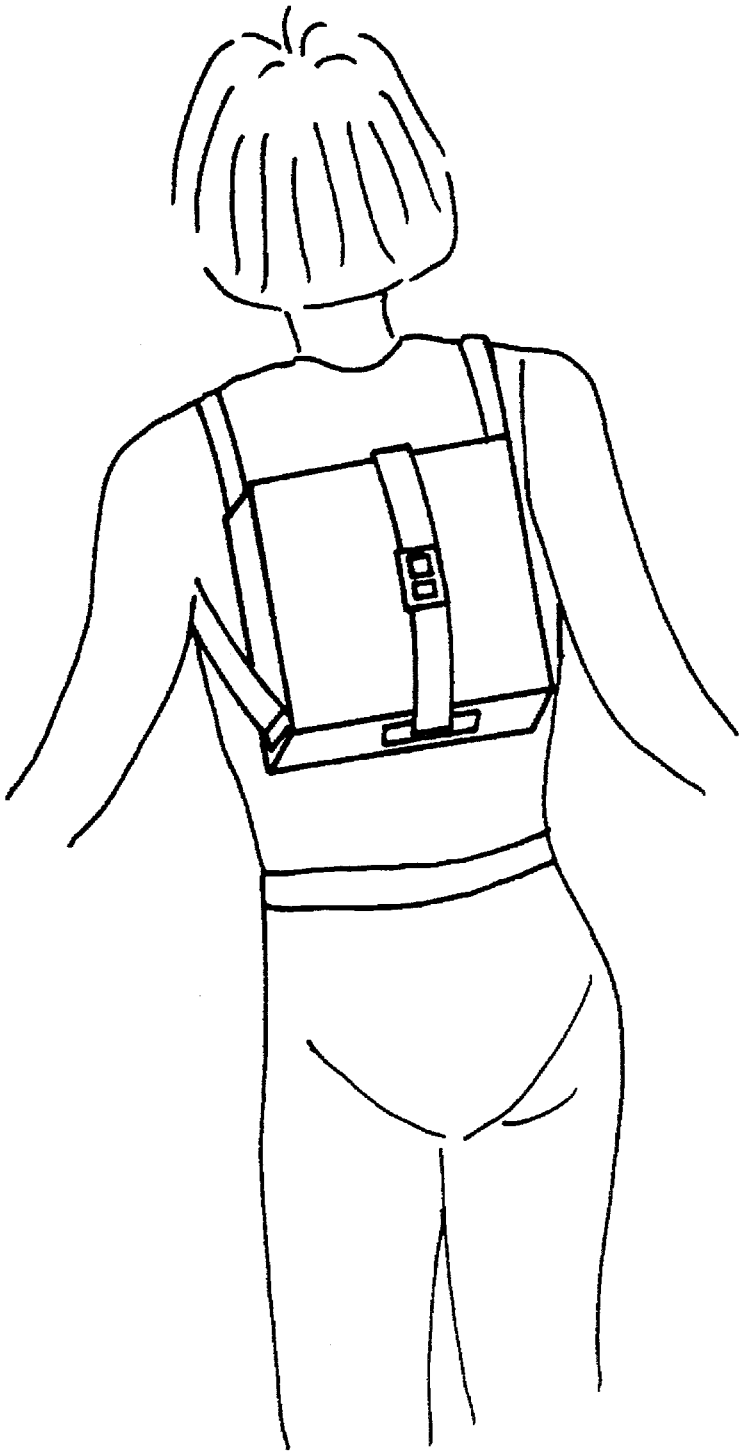
FIG. 7 is an applied view showing the base bag of FIG. 6 carried on the back and used as a life bag.

Referring to FIG. 7, when the air bag 5 is received in the air bag 1, the base bag can thus be carried on the back and served as a life bag.

While only few embodiments of the present invention have been shown and described, it will be understood that various modifications and changes could be made without departing from the spirit and scope of the invention.

What is claimed is:

1. A multipurpose bag comprising:

(a) a substantially contoured parallelepiped bag body defining an internal chamber having a releasable closure for opening and closing said bag body, said releasable closure having a pair of laterally displaced side flaps having first and second releasable securement means formed thereon and a pair of front and back flaps extending throughout a lateral dimension of said bag body, said front flap having third and fourth releasable securement means formed on opposing ends of a frontal surface thereof for releasable securement respectively to said first and second releasable securement means and fifth releasable securement means extending throughout said lateral dimension formed on a rear surface of said front flap, said back flap having a sixth releasable securement means formed on a frontal surface thereof for releasable securement to said fifth releasable securement means, said back flap having a first strap slot formed therethrough substantially central said lateral dimension;

(b) a first strap member passing through said first strap slot and buckled adjacent an exterior surface of said bag body; and, (c) a flexible insert member for insert into said internal chamber.

2. The multipurpose bag as recited in claim 1 where said bag body includes:

(a) a pair of laterally displaced side panels, each of said side panels having a pair of second strap slots formed therethrough; and, (b) a second strap extending adjacent a periphery of said body, said second strap passing through each of said second strap slots formed through said side panels of said bag body.

3. The multipurpose bag as recited in claim 1 where said flexible insert member is an air bag.

4. The multipurpose bag as recited in claim 1 where said flexible insert member is a sponge.

5. The multipurpose bag as recited in claim 1 where said first, second, third, fourth, fifth, and sixth releasable securement means are formed of hook-in-loop fastening members.

* * * * *